US005494121A

United States Patent [19]

Nackerud

[11] Patent Number: 5,494,121

[45] Date of Patent: Feb. 27, 1996

[54] CAVERN WELL COMPLETION METHOD AND APPARATUS

[76] Inventor: Alan L. Nackerud, 9681 W. Dumbarton Pl., Littleton, Colo. 80123

[21] Appl. No.: 346,089

[22] Filed: Nov. 29, 1994

Related U.S. Application Data

[63] Continuation-in-part of Ser. No. 234,823, Apr. 28, 1994, abandoned.

[51] Int. Cl.[6] ..... E21B 10/00

[52] U.S. Cl. ..... 175/263

[58] Field of Search ..... 175/57, 263, 265, 175/273, 275, 277

[56] References Cited

U.S. PATENT DOCUMENTS

| | | | |
|---|---|---|---|
| 54,144 | 4/1866 | Hamar . | |
| 639,036 | 12/1899 | Heald . | |
| 1,189,560 | 7/1916 | Gondos . | |
| 1,285,347 | 11/1918 | Otto . | |
| 1,467,480 | 9/1923 | Hogue . | |
| 1,485,615 | 3/1924 | Jones . | |
| 4,116,012 | 9/1978 | Abe et al. | 175/263 X |
| 5,148,875 | 9/1992 | Karlsson et al. | 175/263 X |
| 5,174,374 | 12/1992 | Hailey | 175/263 X |

*Primary Examiner*—Michael Powell Buiz
*Attorney, Agent, or Firm*—John E. Reilly

[57] ABSTRACT

A method and apparatus for increasing the diameter of a well bore in a cavern well completion after a drill pipe has been removed from the well bore and a drill bit has been removed from the drill pipe in which a reaming tool is formed with one or more cutters of a length in excess of the radius of the previous well bore, the cutters being attached by a pin to a coupling at the lower end of the drill pipe, the cutters being in the form of flat cutter blades which are capable of moving from overlapping relation to one another into diametrically opposed perpendicular relation to the rotational axis of the drill pipe and coupling when the drill pipe is rotated. The rotating drill pipe can be raised or lowered to lengthen the enlarged well bore to form an increased surface area of pressurized formation which is open to communicate with the less pressurized interior of the well bore and thereby substantially increase production flow rates.

17 Claims, 6 Drawing Sheets

CAVERN WELL COMPLETION METHOD AND APPARATUS

CROSS REFERENCE TO RELATED APPLICATION

This is a continuation-in-part application of Ser. No. 234,823, filed 28 Apr., 1994 entitled CAVERN WELL COMPLETION by Alan L. Nackerud, now abandoned.

BACKGROUND OF THE INVENTION

This invention relates to method and apparatus for reaming or enlarging earth bore diameters; and more particularly relates to a novel and improved method and apparatus for cutting through a productive downhole formation to form a well bore diameter substantially larger than a conventionally drilled well bore in order to increase production rates.

In the recovery of petroleum or other gas or liquid substances from subterranean formations, a well bore is formed into the earth and into or beyond the producing formation. A productive well bore is then "completed" either by conventional "cased hole" or "open hole" completion.

In conventional cased hole completion, the casing is run into the completed well bore through and beyond the productive formation after which the casing is cemented in place and then perforated to provide communication between the producing formation and the interior of the casing. Conventional perforations form holes in the casing approximately ⅜" in diameter and the perforation projectile travels a distance of a few inches to a few feet into the formation. Conventional wells typically have one or more perforations per foot.

In conventional open hole completion, the well bore is drilled into the top portion of the productive formation and casing is run to the top of the productive formation and cemented in place. The well bore is then deepened through the productive formation and left open to communicate with the interior of the well bore. Generally, this method establishes more communication with the well bore than a conventional cased hole. The types of completion described are somewhat effective in formations with high permeability. However, with the recent increased number of well completions in formations having low permeability, low production flow rates have resulted with long economic payout periods and unsatisfactory rates of return on investment. The reserves in place may be substantial, but the production flow rates are usually unsatisfactory. The conventional types of completion described provide insufficient productive formation surface area open to communicate with the well bore. Many of the producing formations of these wells are several feet to several hundred feet thick and friable yet structurally strong enough not to collapse when open hole completed.

In the past, many conventional well completions have included various flow rate enhancement treatments including chemical treatments, fracture proppant treatments, horizontal drilling and combinations thereof. Nevertheless, conventional open hole and cased hole completions and subsequent treatments have suffered from numerous drawbacks including:

(a) the surface area of productive formation open to communicate with the interior of the well bore is marginal;

(b) the introduction of foreign treatment chemicals to the formation often chemically alters the formation, activating clays and other flow restricting minerals;

(c) the proppants often break down from formation pressure and create fines which restricts production flow;

(d) the proppant fracture treatments fill the well bore with unwanted proppant precluding installation of downhole production equipment. An expensive workover rig capable of removing the proppant out of the well bore must be employed;

(e) the polymer gels used to assist the proppant into the induced fractures do not entirely break down to a retrievable fluid which restricts production flow;

(f) the chemical or proppant treatments are not controllable as to where they propagate. Neighboring zones containing unwanted production such as salt water are often fractured into and then the unwanted production cannot be stopped;

(g) the chemical and/or proppant may be placed in the induced fractures and yet be squeezed off at any point in the fracture area and especially near the well bore making the proppant ineffective;

(h) the desired production becomes mixed and contaminated with the foreign treatment liquids, gases or solids and are expensive to extract;

(i) the contaminated production postpones initial production revenues;

(j) the contaminated gas production is often vented to atmosphere and contaminated liquid production often incorrectly disposed of causing environmental contamination;

(k) the mixing of treatment chemicals with formation solids, liquids and gases often forms corrosives that corrode production equipment and pipelines;

(l) the horizontal drilling requires an expensive and complicated downhole directional drilling tool and still provides only a marginal increase in the productive formation surface area open to communicate with the well bore;

(m) the chemicals and acids used are a human health hazard and when not properly handled cause serious accidents;

(n) the foreign treatment proppants cause scoring damage and blockage to pumping equipment;

(o) the chemical and proppant fracture treatments require additional equipment, such as, frac tanks, sand and/or chemical trucks, and pumping trucks which cause additional damage to the landowner's surface;

(p) the oil and natural gas purchasers and pipeline companies will not allow numerous fracture treatment gases and liquids in the production because it lowers its heating value; and (q) the initial flow rate tests are inaccurate due to flow back of treatment fluids and treatment gases.

It is therefore desirable to provide for a method and apparatus for substantially increasing the surface area of the productive formation in such a way as to result in substantially increased production rates and to overcome the numerous problems and drawbacks inherent in conventional open hole and cased hole completions as well as subsequent enhancement treatments. In particular, it is proposed to employ a novel and improved reaming device for enlarging a well bore diameter at the productive formation which is characterized by its ease of installation, operation, versatility and reliability in use.

Representative reaming tools are disclosed in U.S. Pat. Nos. 54,144 to Hamar, 639,036 to Heald, 1,189,560 to Gondos, 1,285,347 to Otto, 1,467,480 to Hogue and 1,485,615 to Jones. Although these devices generally disclose the concept of utilizing one or more pivotal cutters which will swing outwardly under centrifugal force into cutting engagement with the sides of a hole, they are lacking in any suggestion of utilizing flat rigid cutter blades which are capable of swinging outwardly from a position in which the blades are disposed in overlapping relation to one another to a perpendicular position to the rotational axis and which will afford adequate relief for the removal of formation cuttings as the cutter blades are rotated.

SUMMARY OF THE INVENTION

It is therefore an object of the present invention to provide for a novel and improved well completion method and apparatus which will substantially increase the surface area of a pressurized productive formation which is enlarged to communicate with the existing well bore so that increased production rates can be obtained and to do so without formation damage caused by chemical alteration of the formation, or without flow restrictions caused by proppant breakdown tending to release unwanted small particles, or without residual sand in the well bore or residual gels in the formation and will not propagate to neighboring formations containing unwanted production.

It is another object of the present invention to provide for a novel and improved well completion method and apparatus for increasing the surface area of a productive formation in communication with a lesser pressurized interior of a well bore which cannot be squeezed off and become ineffective, does not require extraction of treatment materials from production, and avoids contaminated production as well as avoiding the use of complicated downhole equipment while minimizing pipeline and production equipment corrosion.

It is a further object of the present invention to provide for a novel and improved method and apparatus for well completion of the type described which does not require acids or chemicals hazardous to human and environmental health, avoids proppant scoring and blockage of pumping equipment and which can be carried out without extraneous treating equipment to cause excess land surface damage, avoids lowering of the heating value of the production and minimizes erroneous flow test results.

It is a still further object of the present invention to provide for novel and improved forms of reaming devices for use in combination with a drill pipe or other rotational energy means for enlarging a well bore diameter which are of simplified construction, easy to install, compact, and highly efficient and reliable in use.

In accordance with the present invention, a reaming tool has been devised for use in combination with a drill pipe or other rotatable energy means for enlarging the diameter of a well bore, the reaming tool including a coupling member connectable to a lower end of the rotational energy means, a plurality of elongated cutter blades each in the form of a flat, rigid arm member having outside edge means along opposite elongated edges of the cutter blade and opposed, substantially flat parallel surfaces between the outside edge means, and pivotal cutter means for pivotally connecting an upper end of each of the cutter blades to the coupling such that the parallel surfaces are disposed in parallel to one another and activation of the rotational energy means will cause the cutter blades to pivot in opposite directions away from overlapping relation to one another into a position perpendicular to the bore.

A method in accordance with the present invention for substantially increasing the diameter of a well bore in a cavern well completion after a hollow drill pipe has been pulled out of the well bore and a drill bit has been removed from the drill pipe comprises the steps of attaching at least one pivotal cutter means to the drill pipe, the pivotal cutter means having a plurality of cuttings hole means and an outside sharpened edge means alternately angled in and out along its outside length, a pivotal cutter means being pivotal in one direction to a position perpendicular to the rotational energy means and being restricted from rising further than the perpendicular position, and providing a coupling means which connects the pivotal cutter means to the rotational energy means, lowering the pivotal cutter means to a position in an uncased portion of the well bore, rotating the drill pipe and pivotal cutter means so that a rotational force causes the pivotal cutter means to cut the formation and rotate to a position perpendicular to the drill pipe whereby the cutter means substantially enlarges the diameter of the well bore, and pumping air or drilling mud down the interior of the hollow drill pipe and lifting the formation cuttings between the drill pipe and casing to the surface.

The above and other objects of the present invention will become more readily appreciated and understood from a consideration of the following detailed description of preferred and modified forms of the present invention when taken together with the accompanying drawings in which:

DETAILED DESCRIPTION OF FORM OF INVENTION SHOWN IN FIGS. 1 TO 4

Figure 1:
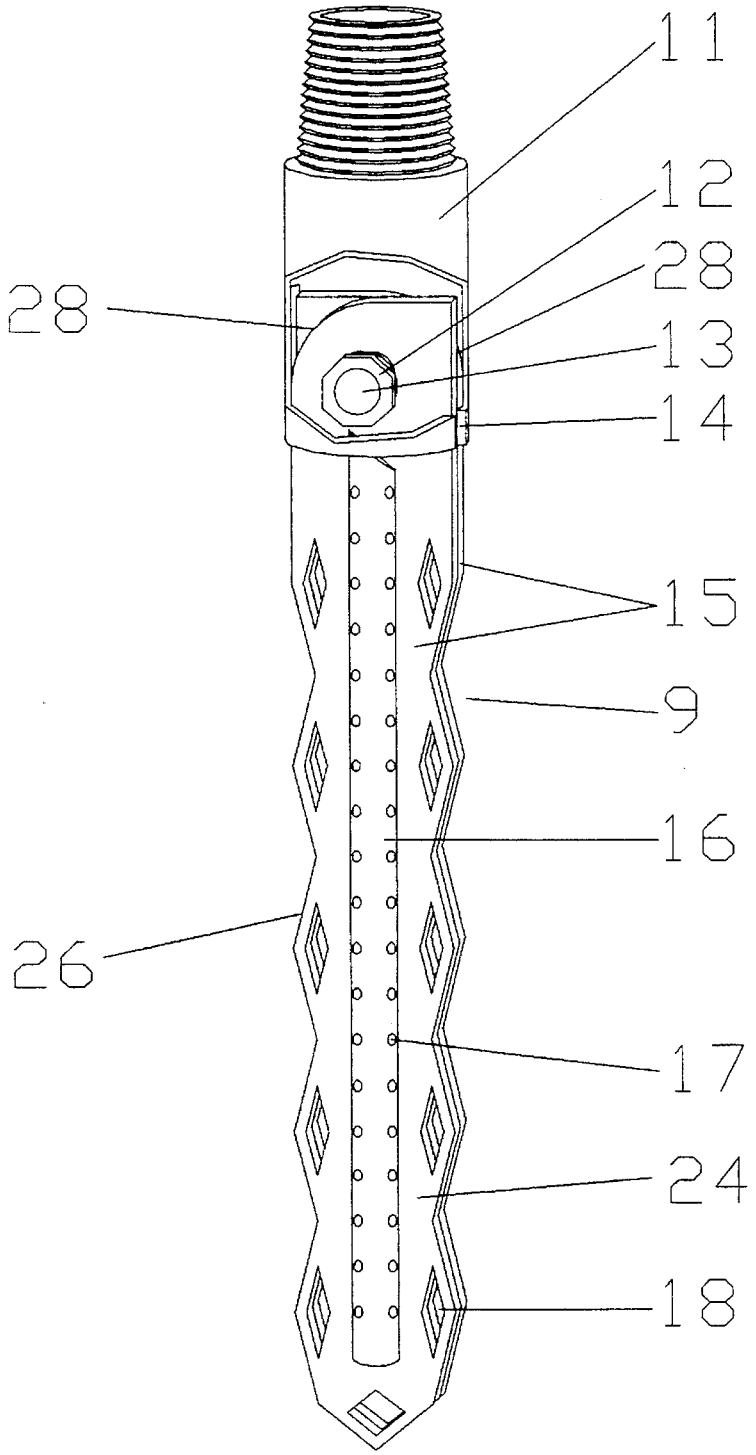
FIG. 1 is a front view in perspective of one form of reaming device in accordance with the present invention.
Figure 2:
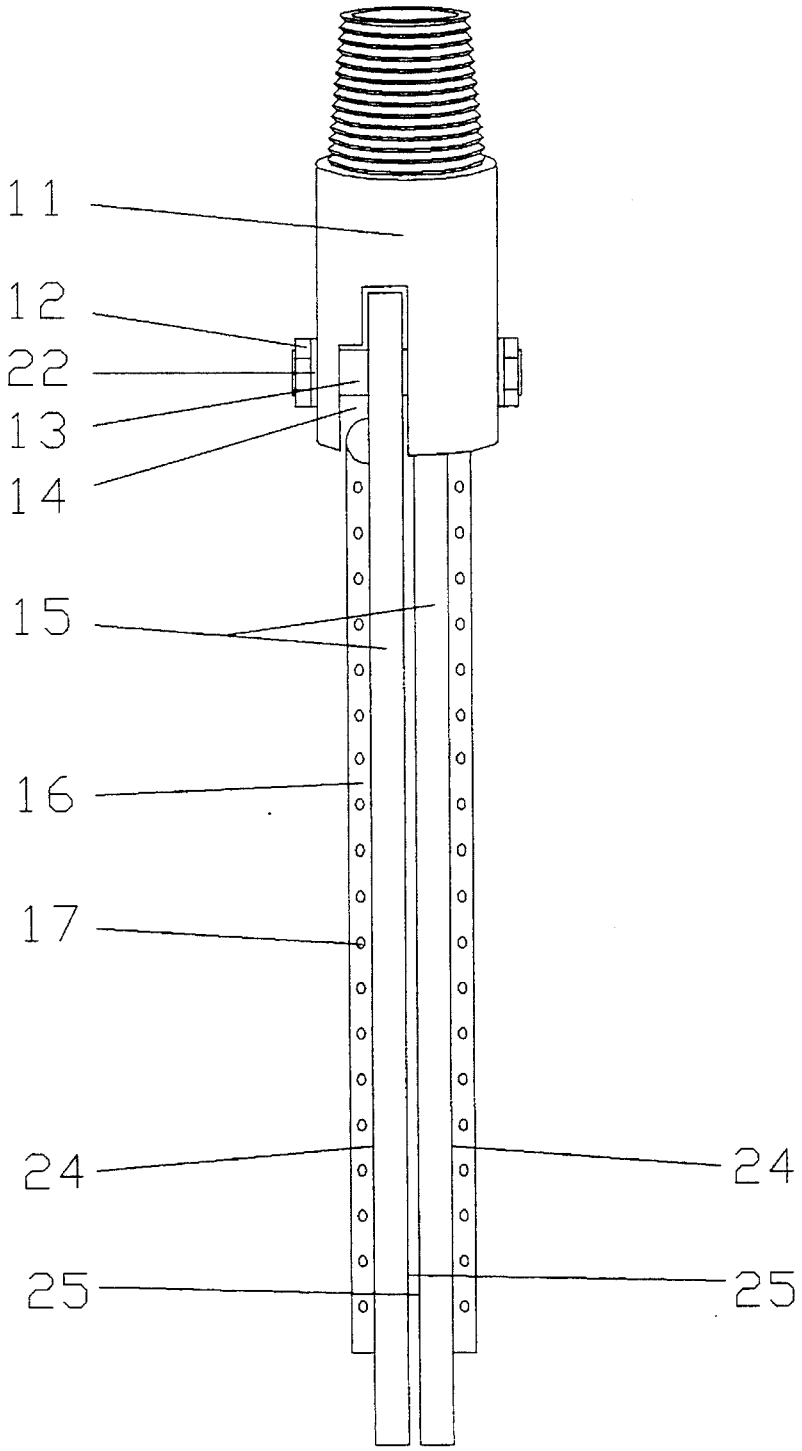
FIG. 2 is a side view in perspective of the reaming device shown in FIG. 1.

Referring in more detail to FIGS. 1 to 4, there is illustrated one form of reaming device 9 having a hollow coupling 11 adapted to be attached to the lower end of a hollow drill pipe 10 or other rotational energy means and a plurality of elongated cutters 15 pivotally connected to the lower end of the coupling by a common attaching element in the form of a pin 13 extending through aligned openings near the bottom of the coupling and is held in place by a washer 22 and a nut 12. When the drill pipe 10 is rotated through the force applied by a conventional drilling rig rotary table, the cutter members 15 are urged under centrifugal force in opposite directions away from a normally vertical orientation into a substantially horizontal orientation perpendicular to the rotational axis through the coupling, as best seen from FIGS. 3 and 4.

Each of the cutters 15 is in the form of a substantially flat, rigid plate or blade having opposed, broad flat surface portions 24 and 25 in parallel to one another throughout its length and alternately angled or serrated cutting edge portions 26 along opposite edges for the substantial length of the blade. A circulation pipe 16 of generally semi-circular cross-section is affixed to one of the opposed, flat surface portions 24 having a series of circulation ports 17 directed toward the outside edge of each cutter 15, the pipe 16 extending the substantial length of the cutter 15. Cuttings holes 18 are arranged at uniformly spaced intervals along the length of each cutter 15 to permit formation cuttings to pass through the holes 18 with minimum resistance.

In order not to interfere with pivotal movement of the cutters 15, the upper end of each cutter has a radial corner 28, the corner 28 on one cutter being formed at an opposite edge opposite to the radial corner 28 of the other cutter. The cutters 15 are suspended by the pin member 13 which extends through a coupling slot 14 at the lower end of the coupling 11, the coupling slot 14 being cut on opposing sides on the bottom of the coupling to allow each cutter 15 to rotate in an opposite direction to a position perpendicular to the drill pipe 10 under the application of rotational force. When the drill pipe is not rotated and the cutters 15 are vertically oriented, as shown in FIG. 1, the flat surface portions of the respective cutters are in direct confronting and overlapping relation to one another and, under rotation of the drill pipe, will rotate away from one another into the perpendicular orientation shown in FIGS. 3 and 4.

Figure 3:
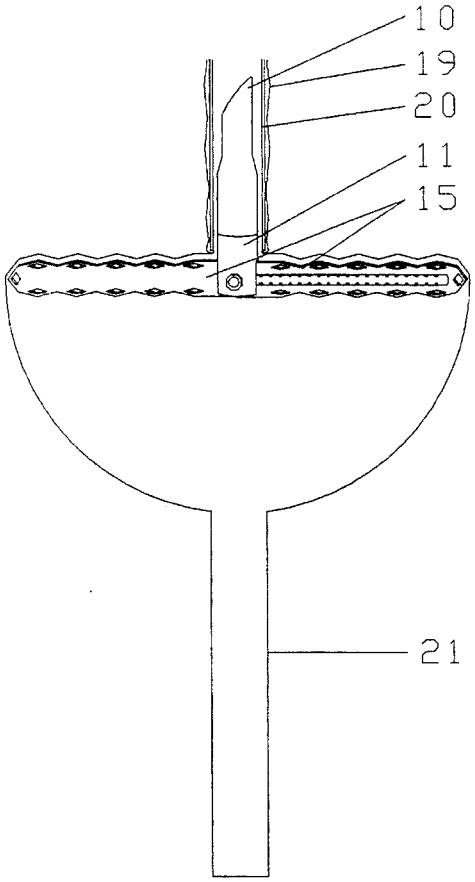
FIG. 3 is a somewhat schematic view of the form of invention shown in FIGS. 1 and 2 in its assembled, rotating position within a well bore.
Figure 4:
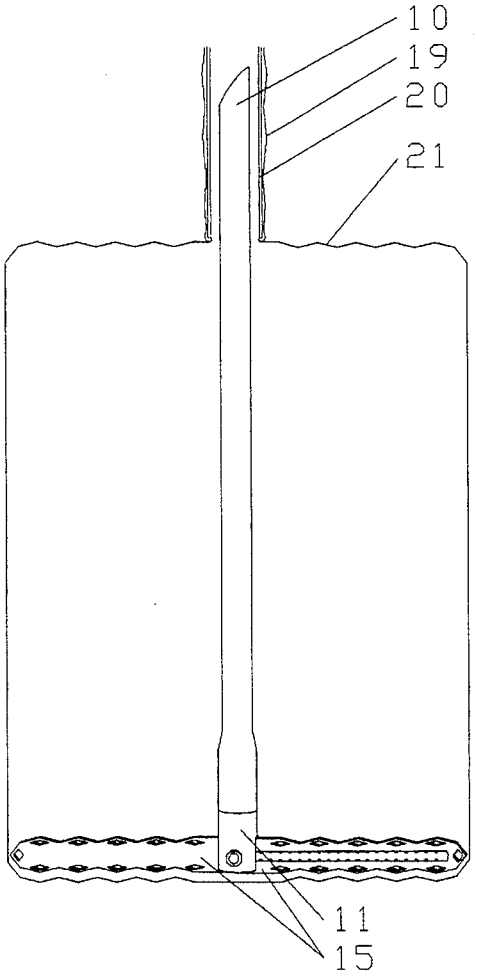
FIG. 4 is another schematic view of the form of invention shown in FIGS. 1 and 2 in a rotating position at the completion of a well bore enlargement operation.
Figure 5:
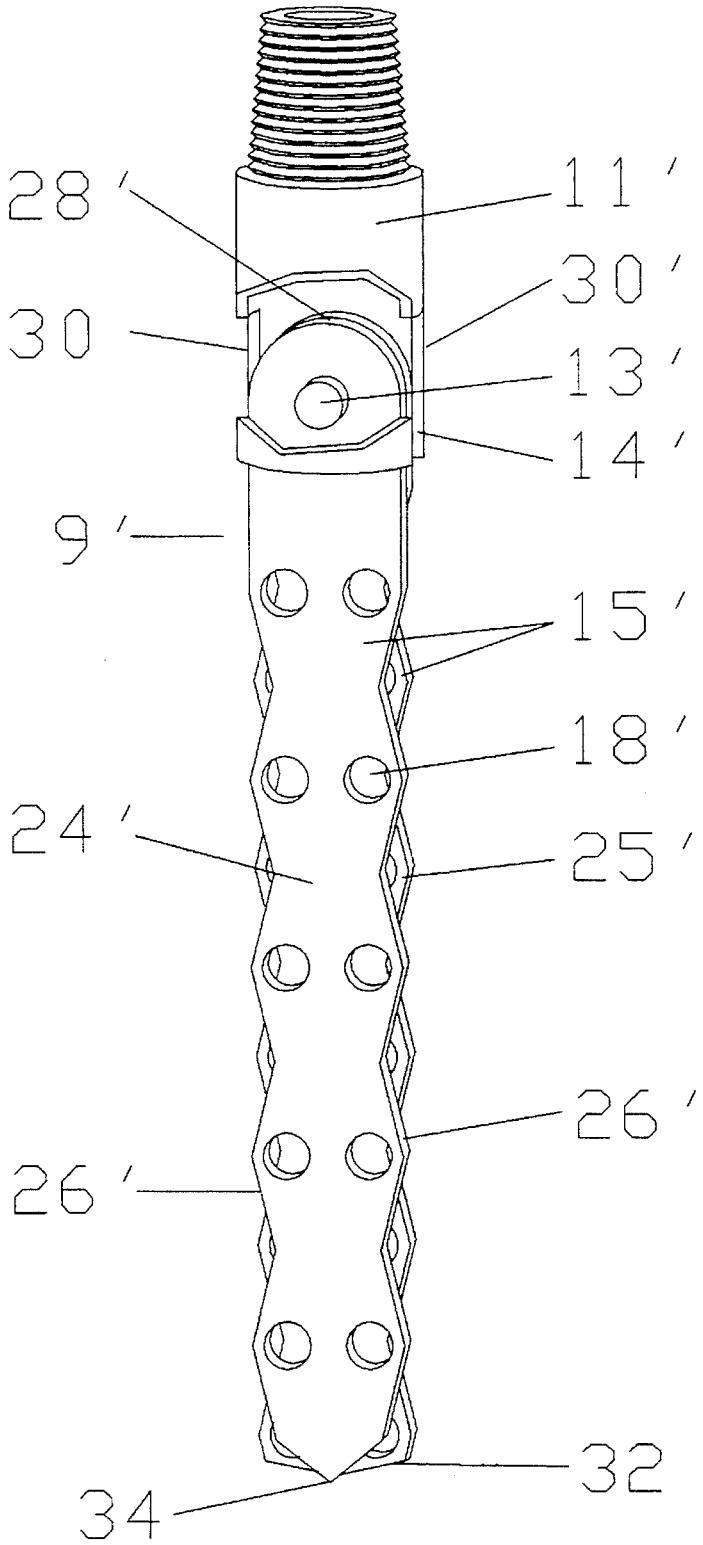
FIG. 5 is another front view in perspective of a modified form of reaming device in accordance with the present invention.
Figure 6:
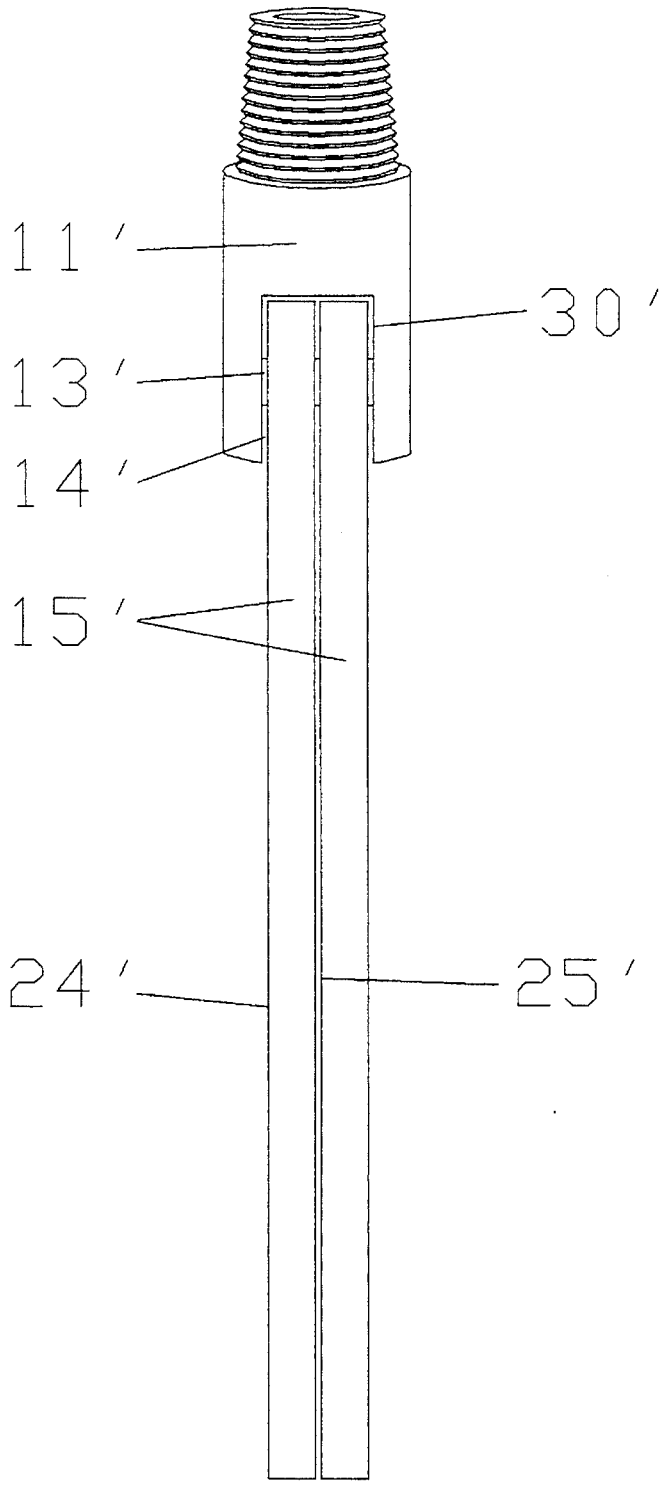
FIG. 6 is a side view in perspective of the form of invention shown in FIG. 4.
Figure 7:
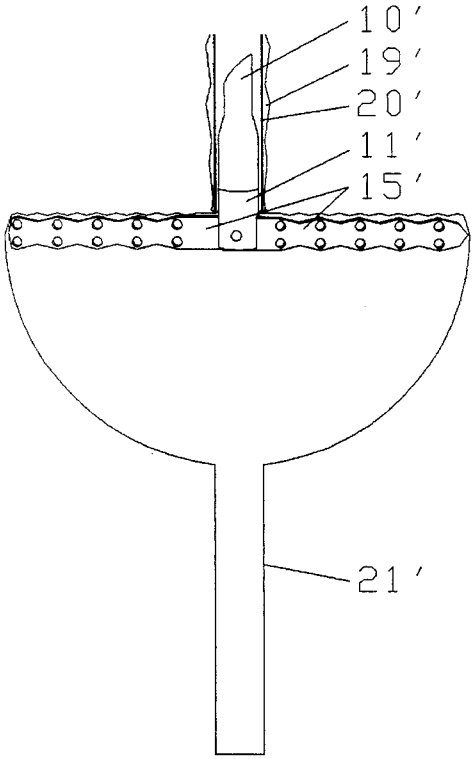
FIG. 7 is a somewhat schematic view of the form of invention shown in FIGS. 5 and 6 in an assembled rotating position within a well bore.
Figure 8:
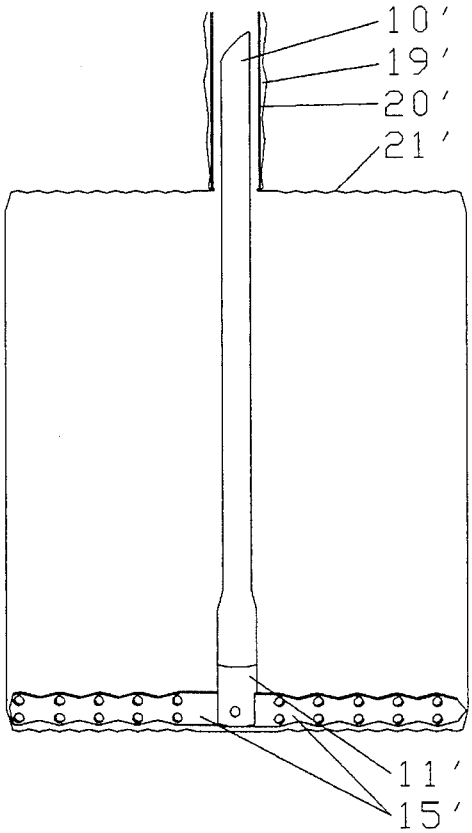
FIG. 8 is a somewhat schematic view of the form of invention shown in FIGS. 5 and 6 at the completion of a well bore enlargement operation.

In operation, the well is drilled to the top of the producing formation in accordance with conventional practice, and a cement layer 19 is placed between a casing 20 and a well bore 21 and allowed to harden. The well bore 21 is then deepened through the producing formation. The drill pipe 10 is withdrawn from the well bore 21 and the conventional drill bit removed. The reaming device 9 is attached to the bottom of the drill pipe 10 and lowered to a position in the uncased portion of the well bore 21. When the drill pipe 10 is rotated by the conventional drilling rig rotary table, the centrifugal force applied to the reaming device 9 will cause the cutters 15 to spread or pivot outwardly as described to cut through the formation and gradually rotate into a position perpendicular to the drill pipe 10, as shown in FIGS. 3 and 4, to substantially enlarge the diameter of the well bore 21. Air or drilling mud is then pumped down the interior of the hollow drill pipe 10 and hollow coupling 11 through the circulation pipes 16 to lift the formation cuttings between the drill pipe 10 and casing 20 to the surface.

The desired height of the enlarged diameter well bore or cavern is completed by raising and lowering the drill pipe 10. As shown in FIG. 4, the drill pipe is continuously rotated until the cutters 15 form a cavern in which the top side is perpendicular to the drill pipe 10; or, in the alternative, a sloped top side could be cut with a slower rotational speed of the drill pipe 10. The cutter arms 15 have lengths equal to the radius of the desired cavern, or shorter length cutters may be employed in the event that the well bore 21 is to be progressively enlarged due to formation characteristics or available rotational force. Most desirably, the cutters 15 have a length equal to or slightly less than the thickness of the formation; and by cutting an enlarged diameter well bore through the producing formation, the production flow rate is substantially increased by increasing the surface area of the pressurized reservoir formation open to communicate with the interior of the less pressurized cased well bore 21.

DETAILED DESCRIPTION OF FIGS. 5 to 8

In the modified form of invention shown in FIGS. 5 to 8, like parts to those of FIGS. 1 to 4 are correspondingly enumerated with prime numerals. As in the form of FIGS. 1 to 4, a reaming device 9' includes a hollow coupling 11' having an upper threaded end portion for threaded connection to the lower end of a drill pipe 10'. A pair of cutter arms 15' are pivotally connected within a slotted portion 14' at the lower end of the coupling 11' by a single pin 13'.

Each of the cutter arms 15' is in the form of an elongated flat plate member having a length corresponding to the desired radial length of the enlarged cavern to be formed out of the well bore 21'. Further, each cutter arm 15' has opposed, flat parallel surface portions 24' and 25' with alternately angled or serrated portions 26' along opposite side edges, and cuttings holes 18' are formed in each cutter arm 15' at uniformly spaced intervals for passage of formation cuttings therethrough. The slotted portion 14' has side openings 30' in diametrically opposed sidewall portions of the lower end of the coupling 11' aligned with upper ends of the cutter arms 15' to permit outward pivotal movement of the cutter arms 15' in opposite directions away from the coupling when rotated by the drill pipe 10'. In that the cutters 15' are mounted on a common pin 13' with the rotational axis through the coupling extending between the cutters 15' the cutters 15' will pivot in opposite directions to one another through the diametrically opposed side openings 30' and not require any form of restraint as described in connection with FIGS. 1 to 4. Further, to this end, an upper terminal edge 28' of each cutter arm 15' is of rounded or generally semi-circular configuration so as not to interfere with outward pivotal movement of each respective cutter 15' through the slotted portion 14'; and the cutters are restricted from rotating beyond a perpendicular orientation to the drill pipe 10' by the top edge of the slotted portion 14'.

The serrations 26' on one cutter arm may be staggered with respect to the serrations 26' of the other cutter arm, as a result of which the lower distal or free end 32 is given a relatively blunt edge compared to the sharper edge 34 of the other cutter so that the length and weight of the cutters 15' are substantially the same. For practical purposes, the cutter arms 15' can be of corresponding configuration and size without staggering the serrated edges 26'. More importantly, the flat parallel surface portions of the cutter arms enable the cutter arms 15' to be superimposed with the flat surface portions 24' and 25' of each in confronting relation to one another so that the width of each cutting arm can correspond to the substantial diameter of the drill pipe 10' for maximum strength and rigidity. By forming cutting edges along both sides of each cutter arm 15', the cutter arms 15' are capable of cutting or reaming both when the drill pipe is raised and lowered as it is rotated.

It will be evident from the foregoing that the method and apparatus of the present invention can be used on open hole wells or on old wells already cased where the casing and cement across the zone may be cut away by conventional methods to allow the reaming tool to be utilized. In addition, the cutters, coupling and pin may be composed of various high strength materials which will lend sufficient strength and rigidity both to the mounting and cutting force of the cutter arms, and the enlarged well bore itself can be cut in various stages of increasing size by modifying the precise configuration of the cutter arms as well as to vary the speed of rotation of the drill pipe. The coupling and pin could be a ball-and-socket or other retention and pivot means to secure the cutter arms in place yet permit their pivotal movement as described, although a particular advantage is the ability to use a single high strength pin for suspension of both cutter arms from the coupling as opposed to multiple pin members which would tend to reduce the strength of the coupling and pins.

It is therefore to be understood that while different forms of invention are herein set forth, the above and other modifications and changes may be made in the construction of parts and sequence of steps without departing from the spirit and scope of the present invention as defined by the appended claims and reasonable equivalents thereof.

I claim:

1. In apparatus for enlarging earth bores wherein rotational energy means is lowered through an earth bore to a position at which it is desired to enlarge the diameter of said bore, the improvement comprising:

a reaming tool including a coupling member connectable to a lower end of said rotational energy means;

a plurality of elongated cutter blades each in the form of a flat, rigid arm member having outside edge means along opposite elongated edges of said cutter blade and opposed, substantially flat parallel surfaces between said outside edge means; and pivotal cutter means for pivotally connecting an upper end of each of said cutters to said coupling with said parallel surfaces parallel to one another whereby activating said rotational energy means will cause said cutter blades to pivot in opposite directions away from overlapping relation to one another into positions perpendicular to said bore whereby said cutter arms substantially enlarge the diameter of said bore.

2. In apparatus according to claim 1, said reaming tool including means between said coupling and said cutter arms to restrict said cutter arms from rising beyond the perpendicular position.

3. In apparatus according to claim 1, wherein said reaming tool includes means between said coupling means and said cutter arms to cause said cutter arms to pivot in opposite direction into positions substantially perpendicular to said bore.

4. In apparatus according to claim 1, said pivotal connecting means defined by a common pin member extending transversely through upper ends of said cutter arms.

5. In apparatus according to claim 1, said cutter blades including cuttings hole means extending substantially transversely through each of said cutter blades at uniformly spaced intervals along the lengths of said cutter arms.

6. In apparatus according to claim 1, wherein means are provided for pumping air or drilling mud downwardly through said bore for lifting formation cuttings from said enlarged diameter of said bore to the surface.

7. In apparatus according to claim 6, wherein circulation means are provided on said cutter blades for delivery of air or drilling mud into the formation.

8. In apparatus for enlarging earth bores wherein rotational energy means is lowered through an earth bore to a position at which it is desired to enlarge the diameter of said bore, the improvement comprising:

a reaming tool including a coupling member connectable to a lower end of said rotational energy means;

a plurality of elongated cutter blades each in the form of a flat, rigid arm member having outside edge means along opposite elongated edges of said cutter blade and opposed, substantially flat parallel surfaces between said outside edge means; and pivotal cutter means in the form of a pin for pivotally connecting an upper end of each of said cutters to said coupling with said parallel surfaces parallel to one another with said cutter blades disposed on opposite sides of a rotational axis through said coupling member whereby activating said rotational energy means will cause said cutter blades to pivot in opposite directions away from overlapping relation to one another into positions perpendicular to said bore whereby said cutter arms substantially enlarge the diameter of said bore.

9. In apparatus according to claim 8, wherein said pin traverses a slot portion in which the upper ends of said cutter blades are mounted.

10. In apparatus according to claim 8, said cutter blades including cuttings hole means at spaced intervals along the length thereof.

11. A method for substantially increasing the diameter of a well bore in a cavern well completion after a hollow drill pipe has been pulled out of the well bore and a drill bit has been removed from the drill pipe, the improvement comprising the steps of:

attaching at least one pivotal cutter means to the drill pipe, said pivotal cutter means having outside sharpened edge means alternately angled in and out along its outside length;

providing a coupling means which connects the pivotal cutter means to a rotational energy means;

lowering the pivotal cutter means to a position in an uncased portion of the well bore; and rotating the drill pipe and the pivotal cutter means so that a rotational force causes the pivotal cutter means to cut into the formation and rotate to a position perpendicular to the drill pipe whereby said cutter means substantially enlarges the diameter of the well bore.

12. The method of claim 11, further comprising the step of substantially lengthening said enlarged well bore by moving said rotational energy means up or down while rotating the cutter means.

13. The method of claim 11, wherein said cutter means has a plurality of cuttings holes means whereby formation cuttings pass through the cutter means.

14. The method of claim 11, further comprising the step of: attaching circulation pipe means to each of the cutter means whereby a drilling mud or air can pass through said rotational energy means, said coupling means and said circulation pipe means in the removal of formation cuttings from said cavern.

15. The method of claim 14, further comprising the step of: locating circulation port means along the length of the circulation pipe means.

16. The method of claim 11, further comprising the step of providing said coupling means with coupling slot means to permit said cutter means to pivot in opposite directions, unobstructed by said coupling means, to a position perpendicular to said rotational energy means.

17. A method for substantially increasing the diameter of a well bore in a cavern well completion after a hollow drill pipe has been pulled out of the wellbore and a drill bit has been removed from the drill pipe, the improvement comprising the steps of:

attaching at least one pivotal cutter means to the drill pipe, said pivotal cutter means having a plurality of cuttings hole means and an outside sharpened edge means alternatively angled in and out along its outside length, said pivotal cutter means further has a top radial cut corner means to allow the cutter means to pivot in only one direction to a position perpendicular to a rotational energy means, and another top side corner is a ninety degree corner means which restricts the pivotal cutter means from rising further than the perpendicular position;

providing a coupling means which connects the pivotal cutter means to said rotational energy means;

lowering the pivotal cutter means to a position in an uncased portion of the well bore;

rotating the drill pipe and the pivotal cutter means so that a rotational force causes the pivotal cutter means to cut the formation and rotate to a position perpendicular to the drill pipe whereby the cutter means substantially enlarge the diameter of the well bore; and pumping air or drilling mud down the interior of the hollow drill pipe and lifting the formation cuttings between the drill pipe and casing to the surface.

* * * * *